US007444106B2

(12) United States Patent
Kikuchi et al.

(10) Patent No.: US 7,444,106 B2
(45) **Date of Patent: *Oct. 28, 2008**

(54) FIXING MEMBER BY HEATING AND FIXING DEVICE IN IMAGE FORMING APPARATUS

(75) Inventors: Kazuhiko Kikuchi, Kanagawa-ken (JP); Masanori Takai, Shizuoka-ken (JP); Satoshi Himeno, Shizuoka-ken (JP); Yuichi Yokoyama, Kanagawa-ken (JP); Kazuhisa Takeda, Shizuoka-ken (JP); Yasunari Miyazaki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/808,458

(22) Filed: Jun. 11, 2007

(65) Prior Publication Data

US 2007/0237555 A1 Oct. 11, 2007

Related U.S. Application Data

(63) Continuation of application No. 11/260,314, filed on Oct. 28, 2005, now Pat. No. 7,239,840.

(51) Int. Cl.
*G03G 15/20* (2006.01)

(52) U.S. Cl. ..... 399/333; 492/53

(58) Field of Classification Search ..... 399/333; 492/53

See application file for complete search history.

(56) References Cited

U.S. PATENT DOCUMENTS

| | | | | |
|---|---|---|---|---|
| 4,870,464 | A | 9/1989 | Itaya et al. | |
| 5,319,427 | A * | 6/1994 | Sakurai et al. | 399/333 |
| 6,321,062 | B1 | 11/2001 | Kitano et al. | |
| 6,546,223 | B2 | 4/2003 | Kishino et al. | |
| 6,759,118 | B2 | 7/2004 | Finn et al. | |
| 6,927,006 | B2 | 8/2005 | Finn et al. | |
| 7,239,840 | B2 * | 7/2007 | Kikuchi et al. | 399/333 |
| 2004/0190959 | A1 | 9/2004 | Kikuchi et al. | |
| 2005/0201784 | A1 | 9/2005 | Suzuki | |
| 2007/0054077 | A1 * | 3/2007 | Barrese et al. | 428/35.7 |

FOREIGN PATENT DOCUMENTS

| | | | |
|---|---|---|---|
| JP | 03-179480 | A | 8/1991 |
| JP | 10-048985 | A | 2/1998 |
| JP | 11-167300 | A | 6/1999 |

* cited by examiner

*Primary Examiner*—David M Gray
*Assistant Examiner*—Bryan Ready
(74) *Attorney, Agent, or Firm*—Foley & Lardner LLP

(57) ABSTRACT

A heat fixing member according to the invention has a surface layer formed on the surface of the substrate with a three-layer structure of a primer layer, an middle layer, and a topcoat layer. The binder-resin content decreases in order from the primer layer to the topcoat layer. The fluorocarbon-resin content increases in order from the primer layer to the topcoat layer. The topcoat layer is made of a fluorocarbon resin having high ability of release and a fluorocarbon resin having high abrasion resistance. Thus, the surface layer can be prevented from peeling without losing ability of release and can be decreased in abrasion.

24 Claims, 7 Drawing Sheets

| | | p | m | t | TENSILE LOAD | ABILITY OF RELEASE |
|---|---|---|---|---|---|---|
| SAMPLE 1 | FLUORINE | 1 | 1.5 | 2.5 | 2.5 | ○ |
| | BINDER | 2 | 1.5 | 0 | | |
| SAMPLE 2 | FLUORINE | 1 | 1 | 1 | 1 | △ |
| | BINDER | 1 | 1 | 0.5 | | |
| SAMPLE 3 | FLUORINE | 1 | 2 | 1.5 | 1.5 | × |
| | BINDER | 1 | 1.5 | 1 | | |
| SAMPLE 4 | FLUORINE | 1 | 1 | 1 | 3 | × |
| | BINDER | 2 | 2 | 1.5 | | |

FIXING MEMBER BY HEATING AND FIXING DEVICE IN IMAGE FORMING APPARATUS

CROSS-REFERENCE TO RELATED APPLICATIONS

This application is a Continuation of U.S. application Ser. No. 11/260,314, filed Oct. 28, 2005, incorporated herein by reference in its entirety.

FIELD OF THE INVENTION

The present invention relates to a heat fixing member and to a fixing device of an image forming apparatus for fixing a toner image formed by the electrophotographic image forming apparatus such as a copier, a printer, or a facsimile machine, to sheet paper by heat pressing.

DESCRIPTION OF THE BACKGROUND

Fixing devices incorporated in an electrophotographic image forming apparatus, such as copiers, facsimile machines, or printers, include a fixing device for fixing a toner image on sheet paper by heat pressing in which the sheet paper passes through the nip formed between a pair of rollers comprised of a heating roller and a pressing roller, or between a pair of belts. The surfaces of the heat fixing members such as the heating rollers or the heating belts are generally coated with a fluorocarbon-resin topcoat layer to obtain ability of release. Between the core rod and the topcoat layer has been provided a primer layer to increase in adhesion strength.

However, such heat fixing members have not given consideration to increasing the life of the fluorocarbon-resin topcoat layer. Accordingly, the topcoat layers have been worn down at a contact position with a cleaning unit, a thermo sensor, or a separation finger, resulting in a decrease in their life.

There is also an apparatus that heats a heat fixing member by an induction heating method. The induction heating method is a method in which a specified power is supplied to an induction heating coil to generate a magnetic field, and the conductive heat-generation layer of a heat fixing member is heated in a moment by an eddy current generated by the magnetic field, thereby allowing the heating roller or the heating belt to fix the toner image. As the heat-generation layer of the heat fixing member of such an induction heating method, iron-based materials have principally been used in recent years.

The adhesion between the heat-generation layer and the primer layer may be decreased depending on the material of the heat-generation layer of the heat fixing member. Accordingly, when the amount of the binder in the primer layer is increased to improve the adhesion with the heat-generation layer, the bonding force between the primer layer having much binder and the topcoat layer is decreased. On the other hand, with a fixing device of a high-speed machine in which the peripheral velocity of the heat fixing member is fast, to which a high linear load is applied by a press roller, significant mechanical and thermal stress is applied to the boundary between the primer layer and the topcoat layer of the heat fixing member. This might cause separation between the primer layer and the topcoat layer of the heat fixing member, thus decreasing the life of the heat fixing member.

This leads to the demand for a heat fixing member and a fixing device of an image forming apparatus in which the topcoat layer hardly comes off irrespective of the material of the heat-generation layer, and in which the abrasion of the topcoat layer can be prevented to increase the life even in a high-speed fixing device.

SUMMARY OF THE INVENTION

Accordingly, an advantage of the invention is to provide a heat fixing member and a fixing device of an image forming apparatus in which an middle layer is provided between the primer layer and the topcoat layer on the surface of the substrate to prevent the peeling and abrasion of the topcoat layer irrespective of the material of the heat-generation layer, thereby increasing the life even in a high-speed image forming apparatus.

In order to provide the above advantage, the embodiment of the invention includes a substrate having a conductive heat-generation layer; and a surface layer having a ground layer, a middle layer, and a release layer deposited in order on the surface of the substrate.

DETAILED DESCRIPTION OF THE INVENTION

Figure 1:
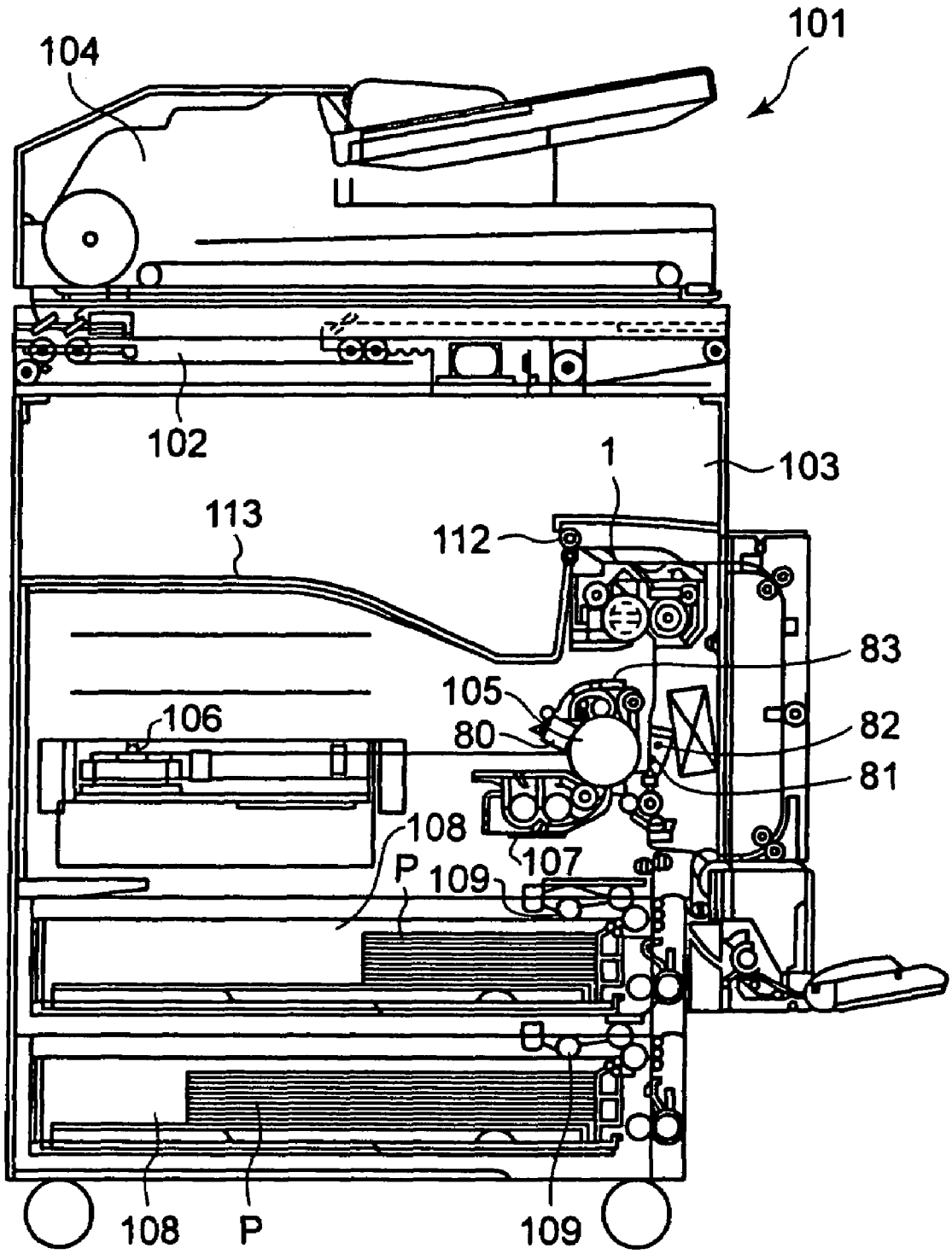
FIG. 1 is a schematic diagram of a digital copier according to an embodiment of the invention.

An embodiment of the invention will be specifically described with reference to the drawings. FIG. 1 is a schematic diagram of a digital copier 101 that is an image forming apparatus including a fixing device 1 according to an embodiment of the invention. The digital copier 101 includes a scanner 102 and an image forming section 103. The scanner 102 is integral with an automatic document feeder (ADF) 104. The image forming section 103 includes a cylindrical photoconductor drum 105 having a photoconductor around the outer surface thereof. The photoconductor drum 105 varies in the potential of the region to which light is applied by an exposure apparatus 106 under a specified potential. The photoconductor drum 105 maintains the change in potential as an electrostatic latent image for a predetermined time.

Around the photoconductor drum 105 are provided a charging device 80 that charges the photoconductor drum 105 evenly; a laser exposure apparatus 106 that forms a latent image on the charged photoconductor drum 105 on the basis of image data from the scanner 102; a developer unit 107; a transfer charger 81; a release charger 82; and a cleaner 83. The image forming section 103 forms a toner image on the photoconductor drum 105 by a known electrophotographic image forming process, and transfers it onto sheet paper P that is a fixed medium. The sheet paper P is taken out from a cassette 108 below the photoconductor drum 105 one by one, and is conveyed to the transfer charger 81 in synchronization with the toner image on the photoconductor drum 105.

Downstream from the photoconductor drum 105 in the conveying direction of the sheet paper P, the fixing device 1 that fixes the sheet paper P to which the toner image is transferred in the position of the transfer charger 81 by heat pressing, and a exit roller 112 that ejects the sheet paper P, to which the toner image is fixed, onto an output tray 113.

Figure 2:
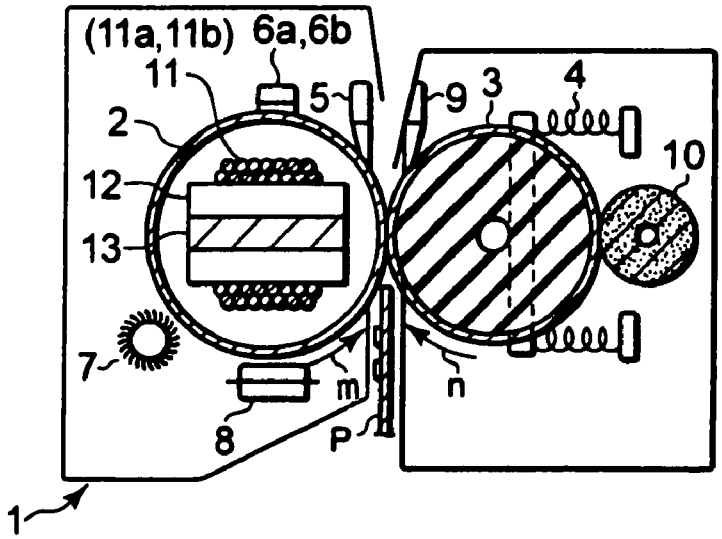
FIG. 2 is a schematic cross-sectional view of a fixing device according to the embodiment of the invention.
Figure 3:
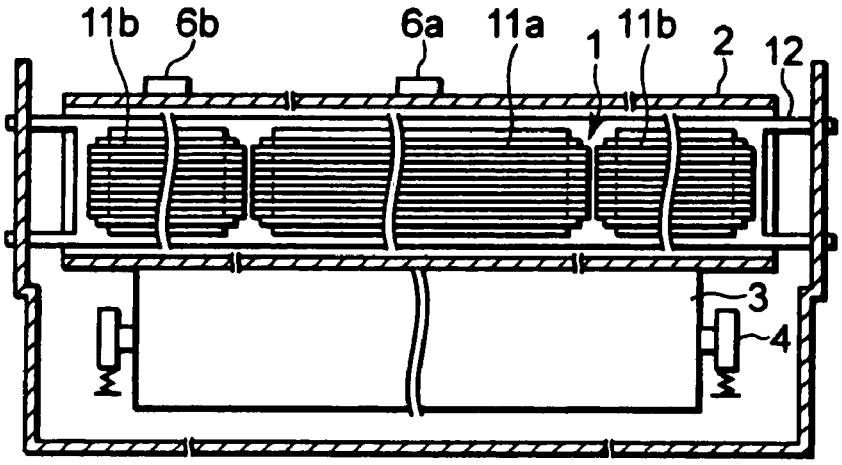
FIG. 3 is a schematic side view of the fixing device according to the embodiment of the invention.
Figure 4:
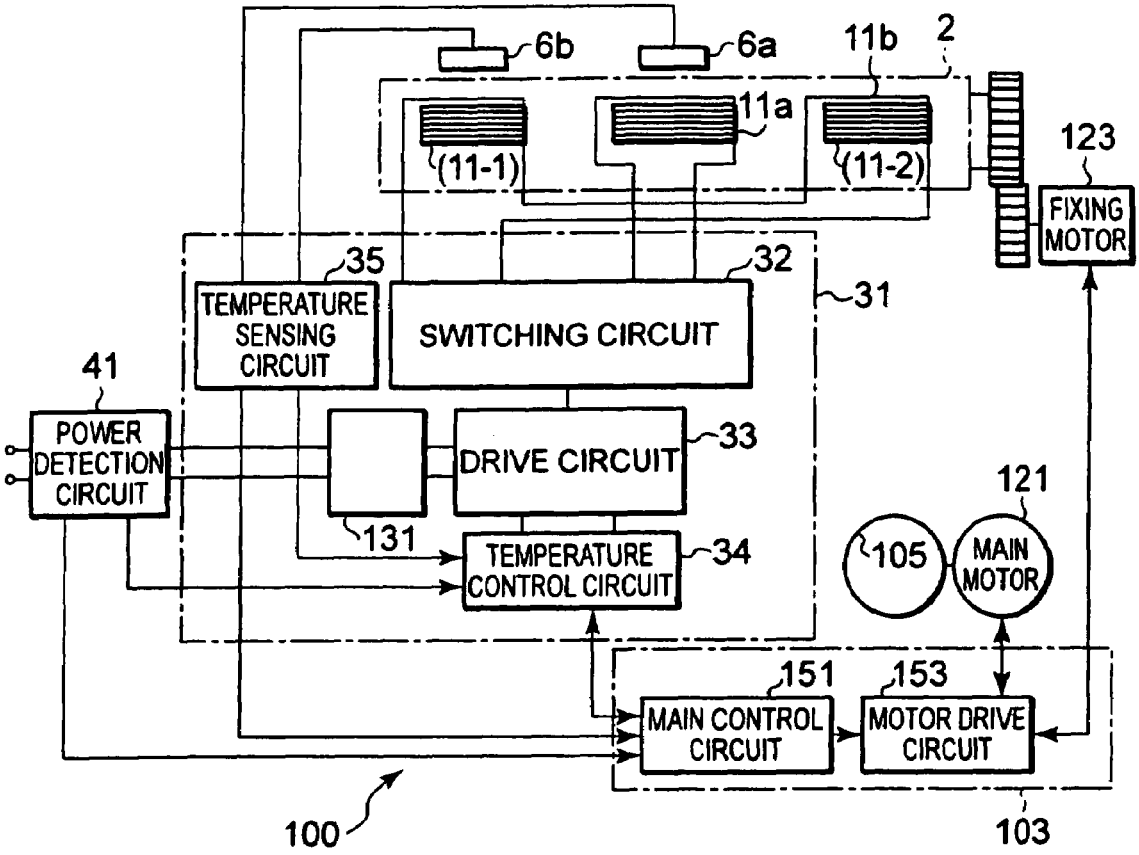
FIG. 4 is a block diagram of the control system of the fixing device according to the embodiment of the invention.

The fixing device 1 will next be described. FIG. 2 is a schematic cross-sectional view of the fixing device 1; FIG. 3 is a schematic side view of the fixing device 1; and FIG. 4 is a block diagram of a control system 100 of the fixing device 1. The fixing device 1 includes a heating roller 2 serving as a heat fixing member and a pressing roller 3 that is a pressurizing member.

Figure 5:
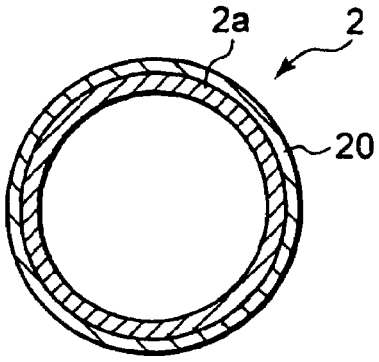
FIG. 5 is a schematic diagram of a heating roller according to the embodiment of the invention.
Figure 6:
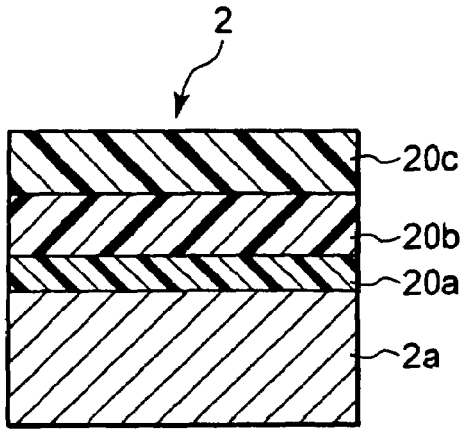
FIG. 6 is a partial cross-sectional view of the heating roller according to the embodiment of the invention.

As shown in FIGS. 5 and 6, the heating roller 2 has a structure in which a surface layer 20 is formed on a hollow-cylinder core rod 2*a*, which is a substrate having a conductive heat-generation layer. The surface layer 20 has a three-layer structure of a primer layer 20*a* that is a ground layer; an middle layer 20*b*; and a topcoat layer 20*c* that is a release layer.

The pressing roller 3 is an elastic roller coated with silicon rubber, fluororubber, or the like around a rotation shaft having a specified diameter. The pressing roller 3 is approximately parallel with the axis of the heating roller 2, and in contact therewith with a specified pressure by a pressurizing mechanism 4. Thus, part of the outer circumference of the pressing roller 3 is elastically deformed to form a specified nip between the rollers 2 and 3.

The heating roller 2 is rotated in the direction of arrow m at approximately fixed speed by a fixing motor 123. The pressing roller 3 is driven in the direction of arrow n opposite to the rotating direction m of the heating roller 2 by pressure contact with the heating roller 2. A separation finger 5 is provided on the heating roller 2, in the vicinity of the nip and at the lower stream of the rotating direction of the heating roller 2 to separate sheet paper P passed through the nip from the heating roller 2. The nip is formed by the heating roller 2 and the pressing roller 3 being in contact with each other. Temperature-sensing elements 6*a* and 6*b*, a cleaning member 7, and an element to detect heat generation abnormalities 8 are provided around the heating roller 2 along the rotating direction of the heating roller 2 and downstream from the separation finger 5.

The temperature-sensing elements 6*a* and 6*b* are comprised of a thermistor or the like, and sense the temperature of the outer circumference of the heating roller 2. At least one of the temperature-sensing elements 6*a* and 6*b* is located approximately in the center in the longitudinal direction of the heating roller 2; the other is located at one end in the longitudinal direction of the heating roller 2.

The cleaning member 7 removes offset toner adhered to the topcoat layer 20*c*, paper powder generated from sheet paper P, or dust floating in the apparatus and adhering onto the heating roller 2. The cleaning member 7 is made of a material that hardly damages the topcoat layer 20*c* even if it comes into contact with the heating roller 2, such as felt or a fur brush. The cleaning member 7 may be rotated by the contact with the surface of the heating roller 2, or alternatively, may not rotate in contact with the outer circumference of the heating roller 2 by a specified pressure.

The heat-generation-anomaly detection element 8 is a thermostat or the like, which detects abnormal heat generation that the surface temperature of the heating roller 2 increases abnormally. The heat-generation-anomaly detection element 8 is used to interrupt the power supplied to an exciting coil 11 serving as a heating member when abnormal heat generation occurs.

A separation finger 9 for separating the sheet paper P from the pressing roller 3 and a cleaning roller 10 for removing toner adhered to the circumference of the pressing roller 3 are disposed on the circumference of the pressing roller 3.

The exciting coil 11 is disposed inside the heating roller 2 to cause the core rod 2*a* to generate an eddy current. The exciting coil 11 includes a first coil 11*a* located approximately in the center in the longitudinal direction of the heating roller 2 and a second coil 11*b* disposed on both ends of the heating roller 2. The first and second coil 11*a* and 11*b* are formed such that a specified wire (including litz wires such as a Litz wire) are wound by a specified number of turns. The first and second coils 11*a* and 11*b* are set so as to resonate at a specific resonance frequency to have the maximum resistance. The first and second coils 11*a* and 11*b* can output approximately equal power.

The first and second coils 11*a* and 11*b* are individually wound around a coil support 12. The coil support 12 is made of engineering plastic or ceramic having high thermal resistance and insulation performance. For the coil support 12, for example, a polyether-ether-ketone (PEEK) material, a phenol material, or an unsaturated polyester material can be used. Inside the coil support 12, a core 13 made of molded ferrite is disposed, for example. The core 13 intensifies magnetic flux density available to cause the heating roller 2 to generate heat. The core 13 is principally made of a dust core (dust core) or the like having little loss in high-frequency bands. The coils 11*a* and 11*b* may be coreless coils having no core material. The first coil 11*a* has a length that can heat the short side of an A4-size (JIS) paper, for example.

The exciting coil 11 is supplied with high-frequency output (current and voltage) of a specified frequency by an exciting unit 31 of the control system 100 to generate a specified magnetic field. The exciting unit 31 includes a switching circuit 32 capable of outputting high frequencies to be supplied to each of the coils 11*a* and 11*b*, and a drive circuit 33 that outputs a specified control signal to the switching circuit 32. The switching circuit 32 functions also as a switching device capable of selecting a series connection or a parallel connection of the coils 11*a* and 11*b*.

The switching circuit 32 receives a DC voltage which is rectified from a commercial AC voltage by a rectifying circuit 131 via the drive circuit 33. The drive circuit 33 indicates the switching circuit 32 of a first frequency f1 to be supplied to the coil 11*a* and a second frequency f2 to be supplied to the coil 11*b*. More specifically, the heating power of the heating roller 2 by the coils 11*a* and 11*b* can be set variously by changing the outputs to the coils 11*a* and 11*b* from the switching circuit 32. The heating power can generally be controlled numerically as power consumption by the individual coils.

The power supplied to the coils 11*a* and 11*b* from the rectifying circuit 131 is monitored continuously by a power detection circuit 41 disposed between a commercial power supply and the input terminal of the rectifying circuit 131. The results of monitoring by the power detection circuit 41 are fed back to the drive circuit 33 with a specified timing. To allow detection of the loss etc. of the drive circuit 33, the output of the power detection circuit 41 is input also to a main control circuit 151 of the image forming section 103.

In the fixing device 1 of the induction heating method of this embodiment, a specified high-frequency output (current and voltage) with a specified frequency is applied to the individual coils 11*a* and 11*b* from the switching circuit 32 in heating the heating roller 2. An eddy current is generated at the core rod 2*a* of the heating roller 2 so as to prevent a change in the magnetic field by the magnetic flux generated in the coils 11*a* and 11*b*. Thus the heating roller 2 is increased in temperature.

The heating roller 2 and its surface layer 20 will now be described in detail. In this embodiment, the adhesion between the core rod 2*a* and the primer layer 20*a* is improved by increasing the rate of binder resin in the primer layer 20*a*. Also, the rate of binder resin in the topcoat layer 20*c* is decreased to improve the ability of release. With such a structure, between the topcoat layer 20*c* and the primer layer 20*a* is provided the middle layer 20*b* containing a binder resin and a fluorocarbon resin in a specified proportion to prevent the topcoat layer 20*c* and the primer layer 20*a* separating even under severe conditions for high-speed machines. The middle layer 20*b* has a strong adhesion to both of the primer layer 20*a* and the topcoat layer 20*c*.

The rate of fluorocarbon resin in the primer layer 20*a* is lower than that in the middle layer 20*b*. And the rate of fluorocarbon resin in the middle layer 20*b* is lower than that in the topcoat layer 20*c*. In contrast, the rate of binder resin in the primer layer 20*a* is higher than that in the middle layer 20*b*. And the rate of binder resin in the middle layer 20*b* is higher than that in the topcoat layer 20*c*. This equalizes the adhesion of the layers without losing the ability of release of the topcoat layer 20*c*, thereby increasing the overall adhesion. In forming the surface layer 20, it is subjected to the first burning after the application of the topcoat layer 20*c*, and is then burned again at a temperature lower than that of the first burning to improve the surface property and the abrasion resistance of the topcoat layer 20*c*.

As a method for digitizing the adhesion strength of the surface layer 20 of the embodiment, a pealing test was conducted to evaluate the surface layer (sample 1) of this embodiment, and samples 2 to 4 as comparative examples. The samples were produced by the following process:

(1) Part of a flat plate 2*a* made of the same material as that of the core rod 2*a* was masked, and to which the primer layer 20*a* was applied.

(2) The middle layer 20*b* and the topcoat layer 20*c* were applied onto the primer layer 20*a*.

Figures 7, 8:
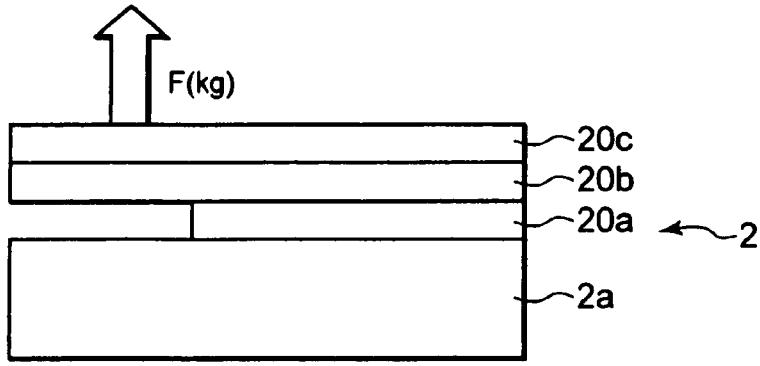
FIG. 7 is a table showing samples for use in testing the surface layer according to the embodiment of the invention.
FIG. 8 is a schematic explanatory diagram of the peeling test according to the embodiment of the invention.

As shown in FIG. 7, in sample 1, the weight ratio of the fluorocarbon resin to the binder resin of the primer layer 20*a* was 1 to 2; that of the fluorocarbon resin to the binder resin of the middle layer 20*b* was 1.5 to 1.5; and that of the fluorocarbon resin to the binder resin of the topcoat layer 20*c* was 2.5 to 0. In sample 2, the weight ratio of the primer layer 20*a* was 1 to 1; that of the middle layer 20*b* was 1 to 1; and that of the topcoat layer 20*c* was 1 to 0.5. In sample 3, the weight ratio of the primer layer 20*a* was 1 to 1; that of the middle layer 20*b* was 2 to 1.5; and that of the topcoat layer 20*c* was 1.5 to 1. In sample 4, the weight ratio of the primer layer 20*a* was 1 to 2; that of the middle layer 20*b* was 1 to 2; and that of the topcoat layer 20*c* was 1 to 1.5.

The peeling test was performed by the method shown in FIG. 8, wherein the tensile load F (kg) when the middle layer 20*b* and the topcoat layer 20*c* are peeled off from the primer layer 20*a* was measured for each sample. For such a peeling test, a strong fluorocarbon resin is applied onto the topcoat layer 20*c* in view of the strength, because the middle layer 20*b* and the topcoat layer 20*c* are very thin. This prevents damage to the middle layer 20*b* and the topcoat layer 20*c*, allowing measurement of even the surface layer 20 of relatively high adhesion strength. The test samples are subjected to the first burning after application of the topcoat layer 20*c*, and then burned again, as in the case of formation of the surface layer 20 of the heating roller 2 according to the embodiment.

As shown in FIG. 7, the tensile loads that cause the peeling of the samples were 2.5 kg for sample 1; 1 kg for sample 2; 1.5 kg for sample 3; and 3 kg for sample 4. The tensile loads are equivalent to the digitized adhesion strength of the surface layer 20.

As shown in FIG. 7, the ability of release of samples 1 to 4 was excellent (○) for sample 1, normal (Δ) for sample 2, and poor (X) for samples 3 and 4. The result of sample 1 is due to that binder-resin content was set to (the primer layer>the middle layer>the topcoat layer), and the fluorocarbon-resin content was set to (the primer layer<the middle layer<the topcoat layer). That is to say, sample 1 is excellent in that good ability of release can be obtained without loosing the adhesion strength of the surface layer 20. The ability of release is evaluated using the amount of the toner (offset) adhered to the heating roller 2. It is evaluated as excellent (○), normal (Δ) or poor (X) from the condition of the toner adhesion when toner is offset from the heating roller 2 to white paper again.

Various tests were conducted using the samples as the surface layer 20 of the heating roller 2 of the embodiment.

[Basal Conditions of Fixing Device 1] (Sample 1)

<Heating Roller 2>

External diameter: ϕ60 mm
Peripheral speed: 420 mm/s
Material of core rod 2*a*: STKM13C (iron) (JIS); Thickness: 1.5 mm
Material of primer layer 20*a*: fluorocarbon resin +binder resin (polyimide resin); Thickness: 0.007 mm
Material of middle layer 20*b*: fluorocarbon resin+binder resin (polyimide resin)+filler; Thickness: 0.007 mm
Material of topcoat layer 20*c*: fluorocarbon resin (PTFE resin+PFA resin); Thickness: 0.007 mm <Pressing Roller 3>

External diameter: ϕ60 mm in diameter
Material: silicon rubber; Hardness: rubber hardness
Pressure (Linear pressure): 2000 N/m
Cleaning member 7: felt cleaning
Heat source: induction heating method The filler contained in the middle layer 20*b* is made of glass fibers or the like, which is mixed to increase the strength of the middle layer 20*b*. The topcoat layer 20*c* contains no filler, because filler is a contributing factor to decreasing ability of release when exposed to the surface at post processing of the heating roller 2 by grinding.

[Test 1]

Figure 9:
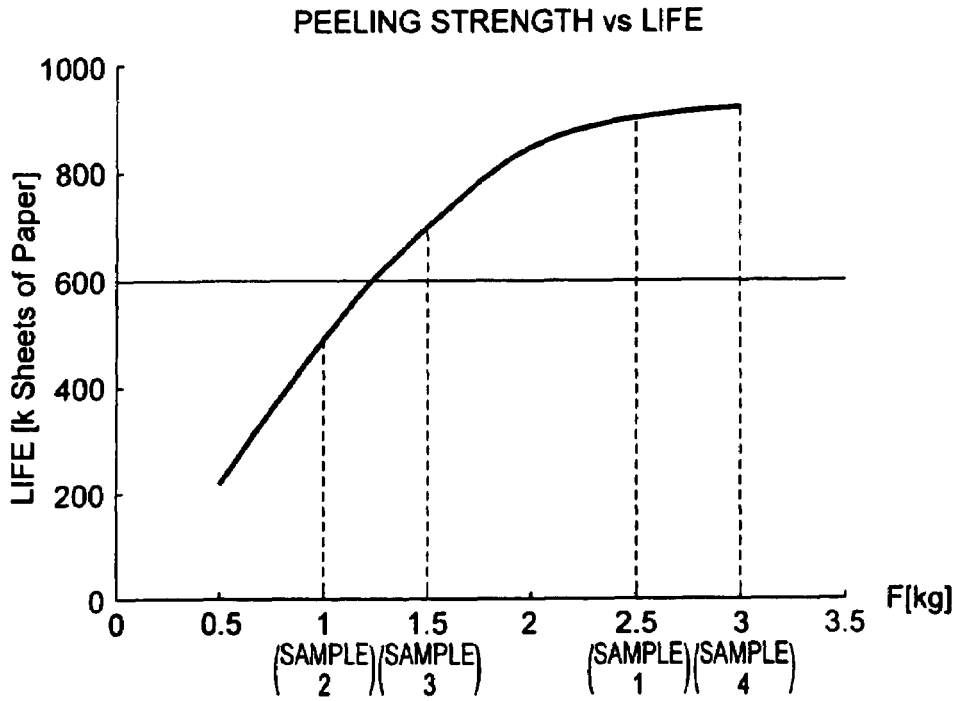
FIG. 9 is a graph showing the results of test 1 according to the embodiment of the invention.

A life test was conducted for samples 1 to 4 under the basal conditions of the fixing device 1. In the life test, the digital copier 101 printed paper in batches of five sheets. The time to determine the life of the heating roller 2 is defined as the point at which the depth of abrasion has reached the thickness of the topcoat layer 20*c*. As shown in FIG. 9, the test results show that samples 1, 3, and 4 whose tensile load, which is the digitized adhesion strength of the surface layer 20, is 1.5 kg or more can provide a print life of 600 K or more sheets.

[Test 2]

Figure 10:
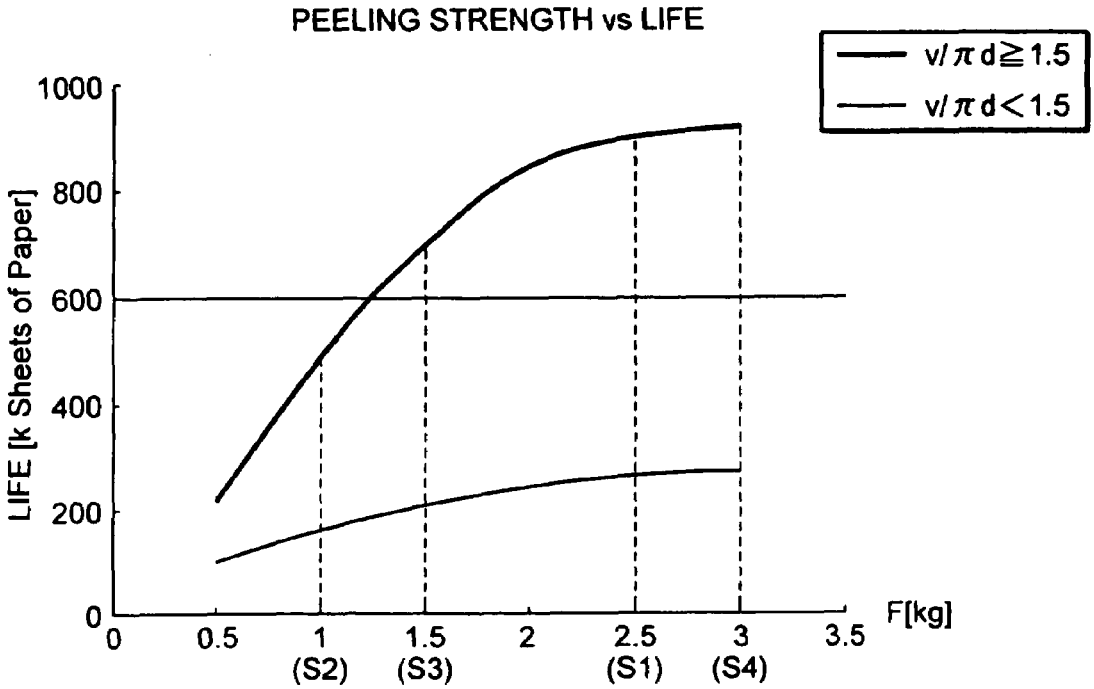
FIG. 10 is a graph showing the results of test 2 according to the embodiment of the invention.

Life tests for relatively high speed of $V/\pi d \geqq 1.5$ and for relatively low speed of $V/\pi d < 1.5$ in Test 1 were conducted where the diameter of the heating roller 2 is d (mm) and the peripheral speed is V (mm/s). As shown in FIG. 10, the test results show that samples 1, 3, and 4 whose tensile loads are 1.5 kg or more could provide desired print life of 600 K or more sheets with $V/\pi d \geqq 1.5$. In contrast, with $V/\pi d < 1.5$, none of samples 1 to 4 could not have desired print life. This is due to the time of contact with the sheet paper P, the separation finger 5, the cleaning member 7, or other members.

[Test 3]

Figure 11:
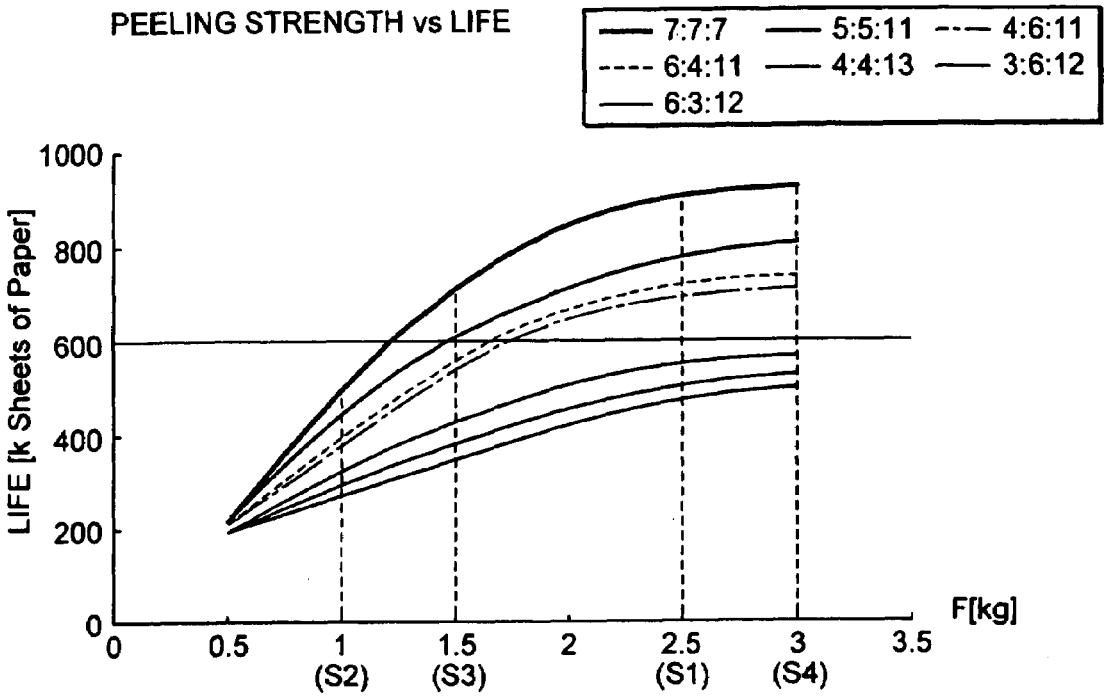
FIG. 11 is a graph showing the results of test 3 according to the embodiment of the invention.

Life tests were conducted when the proportion of the thicknesses of the layers of the surface layer 20 (the basal condition of the fixing device 1) was set to (7:7:7), (5:5:11), (4:6:11), (6:4:11), (4:4:13), (3:6:12), and (6:3:12), and the respective total thicknesses were equally set to 21 μm in Test 1. FIG. 11 shows the test results. The test results show that samples 1, 3, and 4 whose tensile load is 1.5 kg or more could provide a print life of 600 K or more sheets when the thickness ratio of the primer layer 20*a* was in the range from 0.2 to 0.4, the thickness ratio of the middle layer 20*b* was in the range from 0.2 to 0.4, and the thickness ratio of the topcoat layer 20*c* was in the range from 0.3 to 0.5 (when the total thicknesses was 1). The thicknesses of the primer layer 20*a*, the middle layer 20*b*, and the topcoat layer 20*c* of the surface layer 20 were set to 7μ respectively under the basal conditions of the fixing device 1. Accordingly, the proportion of the primer layer 20*a*, the middle layer 20*b*, and the topcoat layer 20*c* was expressed as (7:7:7) ≈ (0.33:0.33:0.33) under the basal conditions of the fixing device 1.

[Test 4]

Figure 12:
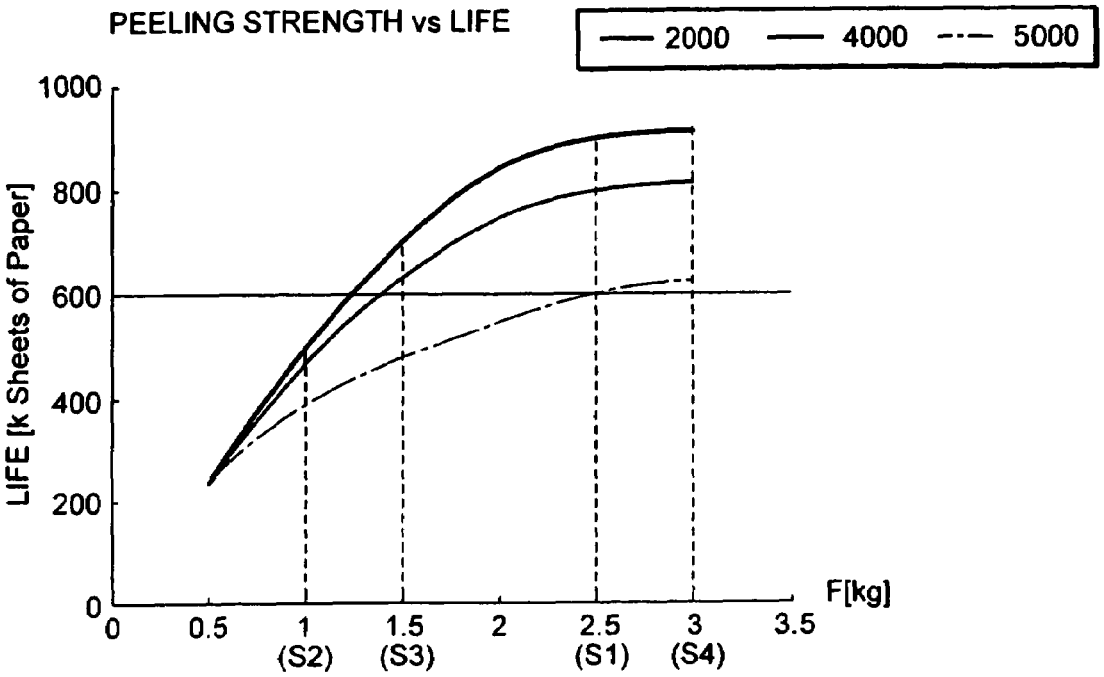
FIG. 12 is a graph showing the results of test 4 according to the embodiment of the invention.

Life tests were conducted when the pressure (linear pressure) of the pressing roller 3 was set to 2,000 N/m, 4,000 N/m, and 5,000 N/m in Test 1. FIG. 12 shows the test results. The test results show that samples 1, 3, and 4 whose tensile load is 1.5 kg or more could provide a print life of 600 K or more sheets when the pressure (linear pressure) was 4,000 N/m or less.

[Test 5]

Figure 13:
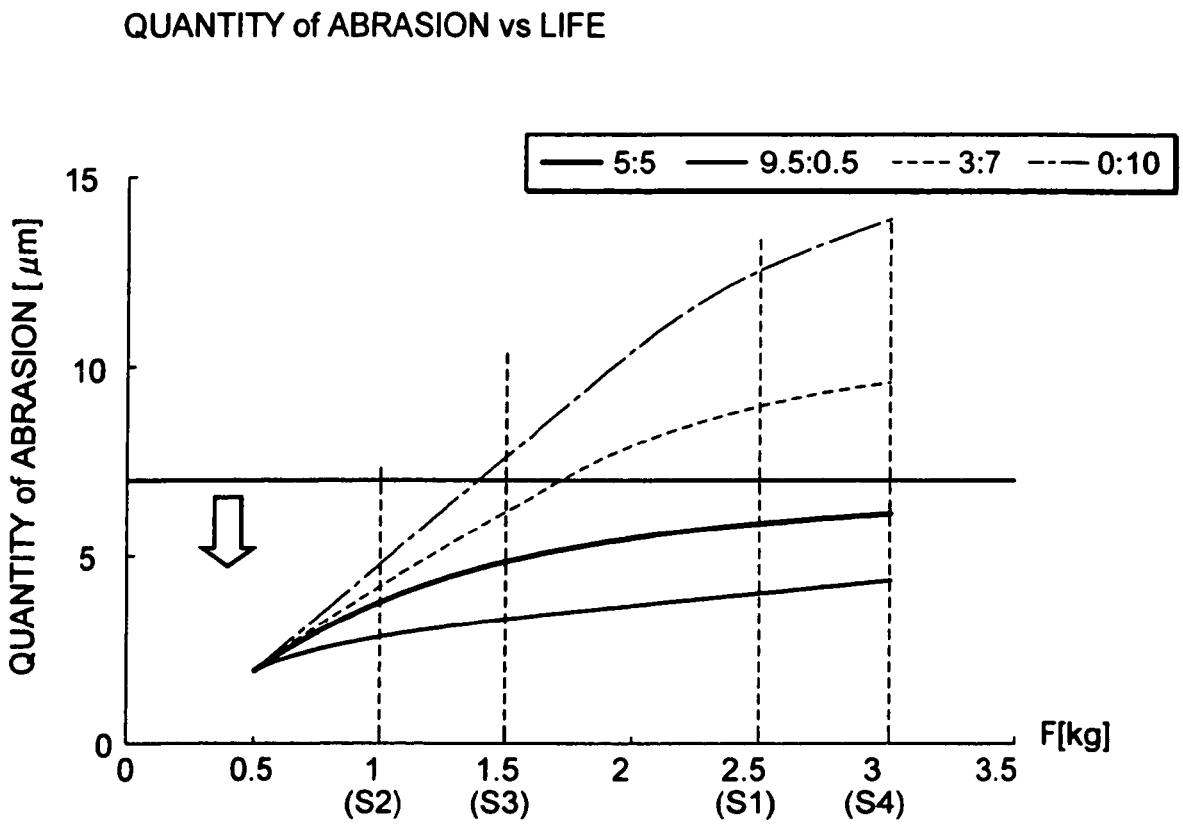
FIG. 13 is a graph showing the results of test 5 according to the embodiment of the invention.

In Test 5, variations in the quantity of abrasion of the topcoat layer 20*c* were tested by changing the compounding ratio of the PTFE-resin material to the PFA-resin material in the fluorocarbon resin of the topcoat layer 20*c* used in Test 1. The weight ratio (PTFE-resin material to PFA-resin material) of the topcoat layer 20*c* was set to (5:5), (9.5:0.5), (3:7), and (0:10). The quantity of abrasion of the topcoat layer 20*c* due to contact with the separation finger 5 was measured after image formation for 600 K sheets of paper, which is a desired life, was measured respectively. As a result, as shown in FIG. 13, the thickness of abrasion after the image formation of 600 K could be kept 7 μm or less in samples 1 to 4, which is the thickness of the topcoat layer 20*c*, when the ratio of the PTFE-resin material to the PFA-resin material was within the range from (5:5) to (9.5:0.5). In general, the PFA resin has excellent ability of release but has poor abrasion resistance. In contrast, the PTFE resin has high abrasion resistance but low ability of release. The topcoat layer 20*c* can obtain high ability of release and high abrasion resistance through the control of the compounding ratio of the PTFE-resin material to the PFA-resin material. This increases the life of the surface layer 20.

According to the embodiment, the surface layer 20 formed on the surface of the core rod 2*a* of the heating roller 2 has a three-layer structure of the primer layer 20*a*, the middle layer 20*b*, and the topcoat layer 20*c* that is a release layer. The binder-resin content decreases in order from the primer layer 20*a* to the topcoat layer 20*c*, as in sample 1, to thereby increase the adhesion strength between the primer layer 20*a* and the core rod 2*a*. On the other hand, the fluorocarbon-resin content increases in order from the primer layer 20*a* to the topcoat layer 20*c* to thereby improve the surface ability of release. The topcoat layer 20*c* of the heating roller 2 can thus be prevented from peeling off irrespective of the material of the core rod 2*a*, providing a long life even in a high-speed fixing device.

Furthermore, the embodiment gives consideration to the weight ratio of the PTFE-resin material to the PFA-resin material of the topcoat layer 20*c*. This can prevent abrasion without losing the ability of release of the topcoat layer 20*c*.

It is to be understood by those skilled in the art that the invention is not limited to the embodiment but may be varied within the scope and spirit of the invention. For example, the turning angle of a cover member which is necessary during maintenance is not limited but may be varied as needed. The image forming apparatus may have any structure; for example, the substrate having a conductive heat-generation layer may not necessarily in roller shape but may be shaped like a belt. Also the material of the heat-generation layer may be iron, stainless steel, nickel, aluminum, an alloy of stainless steel and aluminum or the like. The heating member for heating the heat-generation layer may not be disposed in the substrate but outside the substrate. Also the kind of the fluorocarbon resin and the binder resin used in the surface layer is not limited.

According to the invention, the adhesion strength between the substrate and the ground layer can be increased irrespective of the substrate of the heat fixing member. The release layer can prevent peeling while maintaining preferable ability of release. Thus the heat fixing member can be increased in life even in a high-speed fixing device. The release layer can also decrease in abrasion without losing the ability of release. This also increases the life of the heat fixing member.

What is claimed is:

1. A heat fixing member comprising:

a substrate having a conductive heat-generation layer; and a surface endless member having a ground layer on the surface of the substrate, a middle layer on the surface of the ground layer, and a release layer on the surface of the middle layer;

wherein the ground layer, the middle layer, and the release layer respectively include binder-resin and fluorocarbon-resin.

2. The heat fixing member according to claim 1, wherein the heat-generation layer is made of iron or stainless steel.

3. The heat fixing member according to claim 1, wherein the proportion of the binder-resin contents of the ground layer, the middle layer, and the release layer is (the underground layer>the middle layer>the release layer); the proportion of the fluorocarbon-resin contents of the ground layer, the middle layer, and the release layer is (the underground layer<the middle layer<the release layer).

4. The heat fixing member according to claim 1, wherein the release layer is made of a PTFE resin (polytetrafluoroethylene resin) and a PFA resin (perfluoro-alkyl-vinylether resin), and the weight ratio of the PTFE resin to the PFA resin is in the range from 5:5 to 9.5:0.5.

5. The heat fixing member according to claim 1, wherein when the thickness of the surface endless member is 1, the ratio of the thickness of the ground layer is in the range from 0.2 to 0.4, the ratio of the thickness of the middle layer is in the range from 0.2 to 0.4, and the ratio of the thickness of the release layer is in the range from 0.3 to 0.5.

6. The heat fixing member according to claim 1, wherein the surface endless member is an endless film.

7. The heat fixing member according to claim 1, wherein the middle layer contains filler.

8. The heat fixing member according to claim 1, wherein the substrate is shaped like a roller.

9. A fixing device of an image forming apparatus, comprising:

a heat fixing member having a substrate having a conductive heat-generation layer, and having a surface endless member that includes a ground layer on the surface of the substrate, a middle layer on the surface of the ground layer, and a release layer on the surface of the middle layer, wherein each of the ground layer, the middle layer, and the release layer respectively include a binder-resin and a fluorocarbon-resin;

a heating member that heats the heat fixing member; and a pressurizing member that comes into pressure contact with the heat fixing member to convey a fixed medium having a toner image in a specified direction together with the heat fixing member.

10. The fixing device of the image forming apparatus according to claim 9, wherein the heat-generation layer is made of iron or stainless steel.

11. The fixing device of the image forming apparatus according to claim 9, wherein the proportion of the binder-resin contents of the ground layer, the middle layer, and the release layer is expressed as (the underground layer>the middle layer>the release layer); the proportion of the fluorocarbon-resin contents of the ground layer, the middle layer, and the release layer is expressed as (the underground layer<the middle layer<the release layer).

12. The fixing device of the image forming apparatus according to claim 9, wherein the release layer is made of a PTFE resin (polytetrafluoroethylene resin) and a PFA resin (perfluoro-alkyl-vinylether resin), and the weight ratio of the PTFE resin to the PFA resin is in the range from 5:5 to 9.5:0.5.

13. The fixing device of the image forming apparatus according to claim 9, wherein when the thickness of the surface endless member is 1, the ratio of the thickness of the ground layer is in the range from 0.2 to 0.4, the ratio of the thickness of the middle layer is in the range from 0.2 to 0.4, and the ratio of the thickness of the release layer is in the range from 0.3 to 0.5.

14. The fixing device of the image forming apparatus according to claim 9, wherein the surface endless member is an endless film.

15. The fixing device of the image forming apparatus according to claim 9, wherein the middle layer contains filler.

16. The fixing device of the image forming apparatus according to claim 9, wherein the substrate is shaped like a roller.

17. The fixing device of the image forming apparatus according to claim 16, wherein $V/\pi d \geqq 1.5$ holds where d [mm] is the diameter of the substrate, and V [mm/s] is the peripheral speed of the substrate.

18. The fixing device of the image forming apparatus according to claim 9, wherein the linear pressure to the heat fixing member by the load of the pressurizing member is 4,000 N/m or less.

19. The fixing device of the image forming apparatus according to claim 9, wherein the heating member is an induced-current generating member that generates induced current to the heat-generation layer.

20. The fixing device of the image forming apparatus according to claim 9, further comprising a felt cleaning member that cleans the surface endless member.

21. A heat fixing member comprising:

a substrate having a conductive heat-generation layer; and a surface endless member having a ground layer on the surface of the substrate, a middle layer on the surface of the ground layer, and a release layer on the surface of the middle layer;

wherein the middle layer and the release layer respectively include binder-resin and fluorocarbon-resin.

22. A fixing device of an image forming apparatus, comprising:

a heat fixing member having a substrate having a conductive heat-generation layer, and having a surface endless member having a ground layer on the surface of the substrate, a middle layer on the surface of the ground layer, and a release layer on the surface of the middle layer wherein the middle layer and the release layer respectively include binder-resin and fluorocarbon-resin, a heating member that heats the heat fixing member; and a pressurizing member that comes into pressure contact with the heat fixing member to convey a fixed medium having a toner image in a specified direction together with the heat fixing member.

23. The fixing device of the image forming apparatus according to claim 9, wherein the heat-generation layer is an endless material.

24. The fixing device of the image forming apparatus according to claim 9, wherein the heat-generation layer is a shell shape.

* * * * *